US005937444A

United States Patent [19]

Hochmuth

[11] Patent Number: 5,937,444

[45] Date of Patent: Aug. 17, 1999

[54] GOALKEEPER'S GLOVE INNER HAND PORTION

[76] Inventor: Peter Hochmuth, Weissenburger Str. 19, D-91757 Treuchtlingen, Germany

[21] Appl. No.: 09/084,856

[22] Filed: May 26, 1998

[30] Foreign Application Priority Data

Jul. 24, 1997 [DE] Germany ..... 197 31 787

[51] Int. Cl.[6] ..... A41D 19/00

[52] U.S. Cl. ..... 2/161.1; 2/161.3

[58] Field of Search ..... 2/159, 161.1, 161.3, 2/161.7, 164, 161.6, 161.8, 167

[56] References Cited

U.S. PATENT DOCUMENTS

| | | | |
|---|---|---|---|
| 5,136,725 | 8/1992 | Montero | 2/161.1 |
| 5,500,956 | 3/1996 | Schulkin et al. | 2/161.1 |
| 5,557,803 | 9/1996 | Granich et al. | 2/16 |
| 5,809,571 | 9/1998 | Spitzer | 2/161.1 |

FOREIGN PATENT DOCUMENTS

| | | |
|---|---|---|
| 2628979 | 3/1988 | France . |
| 2721409 | 11/1978 | Germany . |
| 2721538 | 3/1988 | Germany . |

*Primary Examiner*—John J. Calvert
*Assistant Examiner*—Tejash D Patel
*Attorney, Agent, or Firm*—Anderson, Kill & Olick, P.C.

[57] ABSTRACT

A goalkeeper's glove inner hand portion, including four front finger regions, a thumb region, a hand region, and wrist region, the four front finger regions and the thumb region having fingertip pieces, a carrier layer covering the inner hand portion, and an external latex layer put on the carrier layer, with the external latex layer having thickenings provided in regions of the fingertip pieces of the front finger regions, the thumb region, along an outer side of the thumb region, along a hand edge line of the hand region, and in a transition region between the hand and wrist regions, with the thickness of respective thickenings increasing in directions from the hand region toward the wrist region and toward free ends of the finger and thumb regions, respectively, and with the thickness of the respective thickenings diminishing from a predetermined ridge line toward ends of the fingertip pieces of the front finger regions, and the thumb region, toward the hand edge line, and toward the outer side of the thumb region.

4 Claims, 1 Drawing Sheet

GOALKEEPER'S GLOVE INNER HAND PORTION

BACKGROUND OF THE INVENTION

1. Field of the Invention

The present invention relates to a goalkeeper's glove and, in particular to an inner hand portion of a goalkeeper's glove which includes four front finger regions, a thumb region, a hand region, and a wrist region, the four front finger regions and the thumb region having fingertip pieces, a carrier layer covering the inner hand portion; and an external padding layer put on the carrier layer, with the external padding layer having thickenings provided in regions of the fingertip pieces of the front finger regions, the thumb region, and in a transition region between the hand and wrist regions, and with the thickness of respective thickenings increasing in directions from the hand region toward the wrist region and toward free ends of the finger and thumb regions, respectively, so that the thickening portions of the padding layer form a cavity.

2. Description of the Prior Art

German Patent No. 2,721,538 discloses a goalkeeper's glove of the above-described type in which the thickenings of the finger regions, the thumb region, and the transitional region between the hand and wrist region form a cavity the shape of which corresponds to that of a ball only to a very small degree. The external padding layer is formed of an elastic foamed material and is cast on a finished glove, with the inner hand portion being already connected with other conventional elements of the glove.

The inner hand portion forms seam additions that project into the interior of the goalkeeper's glove. The padding layer does not cover these seam additions, i.e., it does not form any seam additions. The thickenings of the front finger regions project over the fingertip pieces as claws, increasing the operational length of the finger portions. The thickenings likewise do not cover the seam additions of the inner hand portion. The foamed material, which is cast over the finished glove, because of the claw-like extension, should be relatively stiff. Therefore, the foamed material has a relatively smooth, i.e., outer surface with insignificant gripping properties. The insignificant gripping properties adversely affect the ball catching characteristics of a goalkeeper's glove.

German Utility Model No. 29600843 discloses a goalkeeper's glove in which the padding layer covering the inner hand portion is formed as a latex layer having a uniform thickness over its entire extent. The inner hand portion is covered with the latex layer independently of other conventional elements of a goalkeeper's glove. The latex layer forms seam additions of the inner hand portions over the carrier layer. In the finished goalkeeper's glove, the seam additions extend outward. The latex layer forms a slightly sucking, i.e., well gripping outer surface and improves the ball catching characteristics of a goalkeeper's glove. The attempts so substitute the foamed padding in the known goalkeeper's glove disclosed in German patent No. 2,721,538 by a latex layer were not successful because the latex layer does not land itself to casting on the inner hand portion of the finished goalkeeper's glove and, besides, the claw-like extensions formed of latex are so weak that they loose their intended function.

Accordingly, an object of the present invention is to provide a goalkeeper's glove with a padding layer with thickenings and the outer surface of which has good gripping properties so that ball catching characteristics of a goalkeeper's glove are improved.

SUMMARY OF THE INVENTION

This and other objects of the present invention, which will become apparent herein after, are achieved, according to the present invention, by providing an inner hand portion of a goalkeeper's glove, in which the padding layer is formed as a latex layer, which is put on the inner hand portion independent of other goalkeeper's glove components, and in which the thickness of the respective thickenings diminishing from a predetermined ridge line toward ends of the fingertip pieces of the front finger regions and the thumb region, toward the hand edge line, and toward the outer side of the thumb region, as a result, the thickenings provided in the regions of the front finger regions, the thumb region, along the hand edge line, along the outer side of the thumb region, and in the transitional region between the hand and wrist regions form together ball-receiving cavity corresponding to the shape of a ball.

In a goalkeeper's glove with an inner hand portion according to the present invention, the ball catching properties are significantly improved due to forming the padding layer form latex. In addition, the formation of the padding layer from latex permitted to eliminate the claw-like extensions which further improved the ball catching characteristics. At that, the thickenings provided in the regions of the finger regions and in the transitional region between the hand and wrist regions are moved closer to each other, forming a cavity the shape of which more closely correspond to the ball shape. The thickenings do no cover the seam additions and, therefore, do not complicate subsequent stitching of the inner hand portion with other elements of a goalkeeper's glove. The latex layer with thickenings is easily connectable with the carrier layer, and it does not interfere with subsequent manufacturing steps. The latex thickenings, which extend along the hand edge line and along the outer side of the thumb region, complement the other thickenings on the inner hand portion and form with them together a cavity-shaped latex bed which is optimally adapted to the ball shape and has a large surface engageable with a ball.

It is particularly preferable and advantageous when the thickness of respective thickenings is reduced toward respective seam additions along inclination lines. Those inclination lines play an important role during casting of the latex thickenings and are necessary for reducing the size of the ball-receiving cavity. It has been found out that the reduction of the cavity size, when the padding layer is formed of latex, further improves the ball catching characteristics or a goalkeeper's glove.

It is further particularly preferable and advantageous when the carrier layer has cotton knitted portions engaging the latex. The cotton knitting is well connectable with the latex, is light and flexible.

BRIEF DESCRIPTION OF THE DRAWINGS

The features and objects of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1:
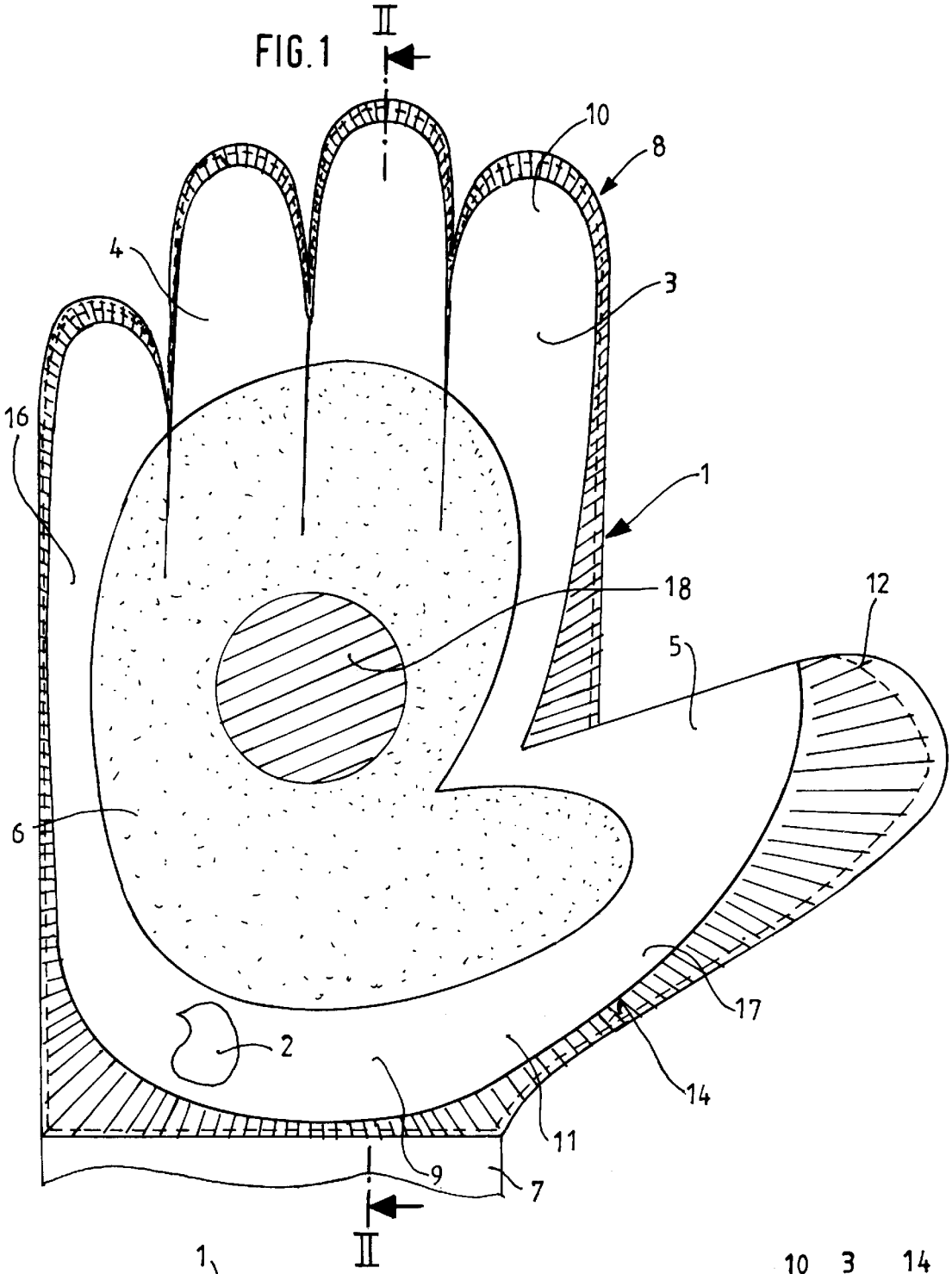
FIG. 1 shows an external view of an inner hand portion of a goalkeeper's glove according to the present invention with thickenings.
Figure 2:
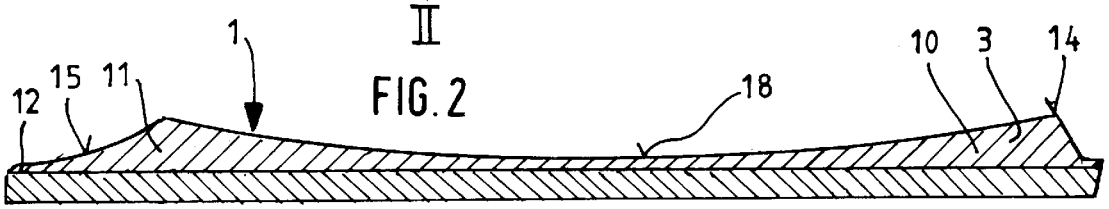
FIG. 2 shows a cross-sectional view along line II—II in FIG. 1.

A goalkeeper's glove according to the present invention has an inner hand portion 1, which is shown in FIGS. 1 and 2 in a flattened condition independently of other conventional parts of the goalkeeper's glove. The inner hand portion 1 has a carrier layer 2 and a latex layer 3 and includes four front finger regions 4, a thumb region 5, a hand region 6, and a wrist region 7. The latex region 3 does not cover the wrist region 7. However, it extends into all other regions of the inner hand portion 1 up to the seam additions 12. The finger region 4 and the thumb region 5 end up each with a fingertip 8. The hand region 6 and the wrist region 7 are connected by a transition region 9.

In the fingertip regions and in the transitional region 9, the latex layer 3 has thickenings 10 and 11, respectively, extending toward the outer side of the latex region 3. The thickenings 10 and 11 increase from the hand region 6 outwardly and end at ridge line 14. From the ridge line 14, the thickness of the thickenings 10 and 11 is reduced in an outward direction along an inclination line 15. In FIG. 1, the inclination line 15 is shown with a straight line. The thickenings 10 and 11 do not cover the seam addition 12 of the latex layer 3. Likewise, a thickening 16 is provided along a hand edge line and extends over the small finger, and a thickening 17 is provided along the outer side of the thumb region. A somewhat plane central region is designated with a reference numeral 18.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A goalkeeper's glove inner hand portion, comprising:

four front finger regions, a thumb region, a hand region, and a wrist region, the four front finger regions and the thumb region having fingertip pieces;

a carrier layer covering the inner hand portion; and an external latex layer put on the carrier layer and extending over the entire inner hand portion except the wrist region, wherein the external latex layer has thickenings provided in regions of the fingertip pieces of the front finger regions, the thumb region, along an outer side of the thumb region, along a hand edge line of the hand region, and in a transition region between the hand and wrist regions, and wherein thickness of the respective thickenings increases in directions from the hand region toward the wrist region and toward free ends of the finger and thumb regions, respectively, with the thickness of the respective thickenings diminishing from a predetermined ridge line toward ends of the fingertip pieces of the front finger regions and the thumb region, toward the hand edge line, and toward the outer side of the thumb region, the thickenings provided in the regions of the front finger regions, the thumb region, along the hand edge line, along the outer side of the thumb region, and in the transitional region between the hand and wrist regions form together a ball-receiving cavity corresponding to a shape of ball.

2. A goalkeeper's glove inner hand portion according to claim 1, wherein the latex layer forms seam additions which are not provided with any of the thickenings.

3. A goalkeeper's glove inner hand portion according to claim 2, wherein the thickness of the respective thickenings is reduced toward respective seam addition along respective inclination lines.

4. A goalkeeper's glove inner hand portion according to claim 1, wherein the carrier layer has cotton knitted portions engaging the latex layer.

* * * * *